US010280590B2

(12) United States Patent
Benson et al.

(10) Patent No.: US 10,280,590 B2
(45) Date of Patent: May 7, 2019

(54) WORK VEHICLE ANTI-BRIDGING SYSTEM AND METHOD

(71) Applicant: Deere & Company, Moline, IL (US)

(72) Inventors: Christopher R. Benson, Asbury, IA (US); Jeffery Dobchuk, Saskatoon (CA); Carl J. Koenig, Asbury, IA (US)

(73) Assignee: DEERE & COMPANY, Moline, IL (US)

( * ) Notice: Subject to any disclaimer, the term of this patent is extended or adjusted under 35 U.S.C. 154(b) by 142 days.

(21) Appl. No.: 15/418,004

(22) Filed: Jan. 27, 2017

(65) Prior Publication Data

US 2018/0216316 A1 Aug. 2, 2018

(51) Int. Cl.

| | |
|---|---|
| ***E02F 9/20*** | (2006.01) |
| ***E02F 3/84*** | (2006.01) |
| ***E02F 9/26*** | (2006.01) |
| *E02F 3/76* | (2006.01) |

(52) U.S. Cl.

CPC ..... *E02F 9/2041* (2013.01); *E02F 3/844* (2013.01); *E02F 9/265* (2013.01); *E02F 3/7609* (2013.01)

(58) Field of Classification Search

CPC ..... E02F 9/2041; E02F 9/265; E02F 3/844; E02F 3/7609

See application file for complete search history.

(56) References Cited

U.S. PATENT DOCUMENTS 5,555,942 A 9/1996 Matsushita et al.
5,694,317 A 12/1997 Nakagami et al.
5,699,248 A 12/1997 Nakagami et al.
5,816,335 A 10/1998 Yamamoto et al.
5,875,854 A 3/1999 Yamamoto et al.
5,950,141 A 9/1999 Yamamoto et al.
5,984,018 A 11/1999 Yamamoto et al.
6,181,999 B1 1/2001 Yamamoto et al.
7,121,355 B2 10/2006 Lumpkins et al.
8,406,963 B2 3/2013 Farmer et al.
(Continued)

OTHER PUBLICATIONS

Madeline Oglesby et al., SmartGradeTM Theory of Operation—DG-TX-NA-CRWL-9000-SmartGrade Design Guideline, Deere & Company, Nov. 24, 2015.

(Continued)

*Primary Examiner* — Todd M Melton

(74) *Attorney, Agent, or Firm* — Klintworth & Rozenblat IP LLP

(57) ABSTRACT

Systems and methods are provided for inhibiting the bridging of a work vehicle. A method adjusts a position of an implement of a work vehicle to inhibit a bridging of the work vehicle. The method includes: receiving, by a processor associated with the work vehicle, a chassis pitch angle associated with a chassis of the work vehicle from the Grade Control System; determining, by the processor, whether the chassis pitch angle is greater than a predefined threshold; receiving, by the processor, a current height of the implement relative to a grade from the Grade Control System; determining, by the processor, an offset to move the implement to a height above the grade based on the current height of the implement; and outputting, by the processor, the offset to the Grade Control System to move the implement to inhibit the bridging of the work vehicle.

20 Claims, 5 Drawing Sheets

(56) References Cited

U.S. PATENT DOCUMENTS

| | | | | |
|---|---|---|---|---|
| 8,473,166 | B2 * | 6/2013 | Zhdanov | E02F 3/845 701/50 |
| 8,548,690 | B2 | 10/2013 | Hayashi | |
| 8,548,691 | B2 | 10/2013 | Hayashi et al. | |
| 8,649,944 | B2 | 2/2014 | Hayashi et al. | |
| 8,655,556 | B2 | 2/2014 | Hayashi et al. | |
| 8,700,273 | B2 | 4/2014 | Farmer et al. | |
| 8,731,784 | B2 | 5/2014 | Hayashi et al. | |
| 8,762,010 | B2 | 6/2014 | Farmer et al. | |
| 8,770,307 | B2 | 7/2014 | Hayashi et al. | |
| 8,924,095 | B2 | 12/2014 | Fehr et al. | |
| 8,948,977 | B2 | 2/2015 | Liu et al. | |
| 8,948,978 | B2 | 2/2015 | Liu et al. | |
| 8,965,639 | B2 | 2/2015 | Liu et al. | |
| 8,983,739 | B2 | 3/2015 | Faivre | |
| 9,551,130 | B2 * | 1/2017 | Hendron | E02F 3/844 |
| 9,580,104 | B2 * | 2/2017 | Green | B62D 11/001 |
| 10,024,031 | B2 * | 7/2018 | Yanagisawa | E02F 3/32 |
| 2011/0153170 | A1 | 6/2011 | Dishman et al. | |
| 2013/0158818 | A1 | 6/2013 | Callaway | |
| 2013/0158819 | A1 | 6/2013 | Callaway | |
| 2014/0257646 | A1 | 9/2014 | Ishibashi et al. | |
| 2015/0019086 | A1 | 1/2015 | Hayashi et al. | |

OTHER PUBLICATIONS

John Deere, 550K/650/700K Crawler Dozers 69-97-kW (92-130hp), JohnDeere.com, Jan. 20, 2016.

John Deere, 700K SmartGradeDozer 97-kW (130 net hp), JohnDeere.com, Jan. 2016.

* cited by examiner

WORK VEHICLE ANTI-BRIDGING SYSTEM AND METHOD

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles and to a system and method that inhibits a backward pitching or bridging of a work vehicle.

BACKGROUND OF THE DISCLOSURE

In the construction industry (and others), various work vehicles are operated to perform various tasks at a work site. For example, crawler dozers (hereafter "dozers"), motor graders (hereafter "graders"), and other bladed work vehicles are well-suited for spreading, shearing, carrying, and otherwise moving relatively large volumes of earth. Bladed work vehicles are now commonly equipped with blade actuation systems enabling an operator to manipulate a work vehicle's blade in multiple degrees of freedom (DOFs). In the case of a crawler dozer, for example, an operator may be able to adjust the height, pitch, and rotational angle of the blade through an electro-hydraulic blade actuation system, which is integrated into a blade control assembly mounting the blade to a forward portion of the crawler dozer. Such multi-DOF blade movement provides a powerful and flexible tool in earthmoving operations. However, as the freedom of blade movement increases, so too does the complexity of the operator controls utilized to control blade movement. This, in turn, provides greater opportunities for sub-optimal positioning of the blade and increases the mental workload placed on an operator of the bladed work vehicle.

Advanced Grade Control Systems (GCSs) have been developed for automatically controlling the blade of the crawler dozer, which reduce operator workload. These GCS systems generally control a movement of the blade, including the blade height and cut depth, to arrive at a desired grade. These GCSs, however, may not take into account other factors associated with the crawler dozer during movement of the blade, for example, instances in which the crawler dozer is stationary or when the blade is unable to cut through the ground (or other material) to form the grade while the crawler dozer is moving. In these instances, the GCSs may continue to lower the blade, which may result in the crawler dozer pitching backwards or "bridging." The bridging of the crawler dozer may damage the crawler dozer, and may create an unsatisfactory work environment for the operator.

SUMMARY OF THE DISCLOSURE

The disclosure provides a system and method for adjusting a position of a blade of work vehicle, such as a dozer, grader and so on, to inhibit a bridging of the work vehicle.

In one aspect the disclosure provides a method for adjusting a position of an implement of a work vehicle to inhibit a bridging of the work vehicle. The implement is movable by a hydraulic circuit controlled by a Grade Control System. The method includes: receiving, by a processor associated with the work vehicle, a chassis pitch angle associated with a chassis of the work vehicle from the Grade Control System; determining, by the processor, whether the chassis pitch angle is greater than a predefined threshold; receiving, by the processor, a current height of the implement relative to a grade from the Grade Control System; determining, by the processor, an offset to move the implement to a height above the grade based on the current height of the implement; and outputting, by the processor, the offset to the Grade Control System to move the implement to inhibit the bridging of the work vehicle.

In another aspect, the disclosure provides a system for adjusting a position of a blade of a work vehicle to inhibit a bridging of the work vehicle. The blade is movable by a hydraulic circuit controlled by a Grade Control System. The system includes a chassis pitch angle received from the Grade Control System that indicates a pitch of a chassis associated with the work vehicle and a current blade height received from the Grade Control System that indicates a current height of the blade relative to a grade. The system includes a processor that: determines whether the chassis pitch angle is greater than a predefined threshold; determines an offset to move the blade to a height above the grade based on the current height of the blade; and outputs the offset to the Grade Control System to move the blade to the height above the grade to inhibit the bridging of the work vehicle.

In another aspect, the disclosure provides a system for adjusting a position of a blade of a work vehicle to inhibit a bridging of the work vehicle. The blade is movable by a hydraulic circuit controlled by a Grade Control System. The system includes a chassis pitch angle received from the Grade Control System that indicates a pitch of a chassis of the work vehicle and a current blade position received from the Grade Control System that indicates a current height of the blade relative to a grade. The system includes a processor that: determines whether the work vehicle is stationary based on work vehicle data received from a source associated with the work vehicle; based on the determination that the work vehicle is stationary, determines whether the chassis pitch angle is greater than a predefined threshold; determines an offset to move the blade to a height above the grade based on the current height of the blade; and outputs the offset to the Grade Control System to move the blade to the height above the grade to inhibit the bridging of the work vehicle.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
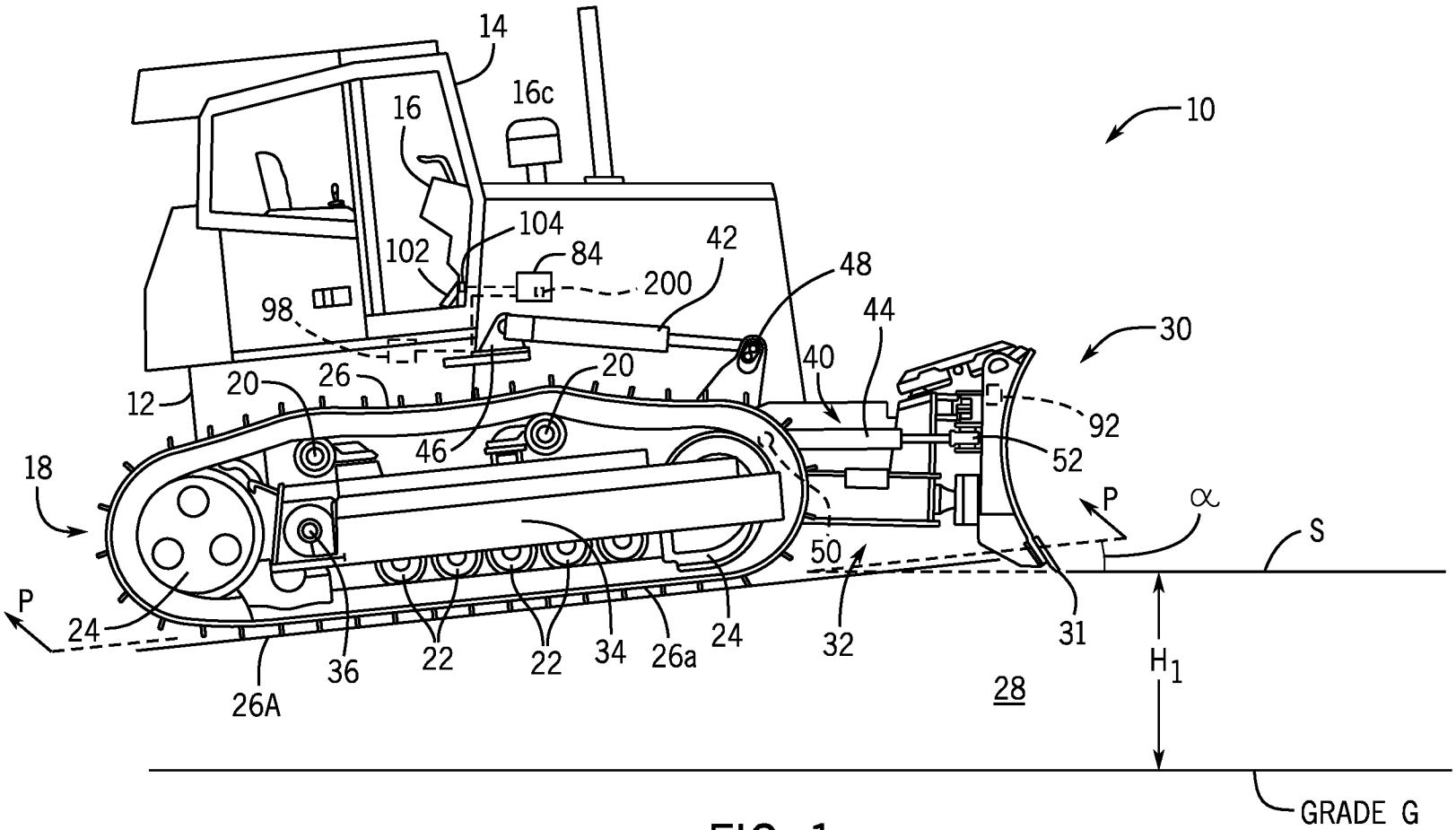
FIG. 1 is a side view of an example work vehicle in the form of a crawler dozer including a blade control linkage, in which the disclosed anti-bridging system and method may be used.

The following describes one or more example embodiments of the disclosed system and method, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of work vehicles, and that the crawler dozer described herein are merely one exemplary embodiment of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

The following describes one or more example implementations of the disclosed system and method for inhibiting bridging or a system and method for anti-bridging of a work vehicle, such as a crawler dozer, as shown in the accompanying figures of the drawings described briefly above. Discussion herein may sometimes focus on the example application of the anti-bridging system and method for a crawler dozer. In other applications, other configurations are also possible. For example, work vehicles in some embodiments may be configured as various bladed work vehicles, including graders or similar machines. Further, work vehicles may be configured as machines other than construction vehicles, including machines from the agriculture, forestry and mining industries, such as tractors having a bladed implement, and so on. Thus, the configuration of the anti-bridging system and method for use with a crawler dozer is merely an example.

When utilized to perform a grading operation or similar task, the work performed with the crawler dozer may be divided into multiple operational phases. These phases may include a loading phase, a carry phase, an offloading or "shedding" phase, and a return phase. During the loading phase, the crawler dozer is controlled by a Grade Control System (GCS) such that the blade penetrates into the ground (or other material) to a desired cut depth at a desired height above a grade. Generally, the grade for the land is predefined by the operator prior to the grading operation. During loading, forward movement of the crawler dozer will typically be primarily resisted by the forces required to shear or dislodge earth and introduce the displaced earth into the volume of loose material pushed by the blade of the crawler dozer.

After the crawler dozer completes a given loading phase, the blade is typically lifted such that little to no additional earth is sheared from the ground. The crawler dozer thus enters the carry phase. After pushing the pile (FIG. 1) to its desired destination, the crawler dozer disengages from the pile (the shedding phase). The crawler dozer is then repositioned to perform another pass (the return phase), the blade is again lowered into the earth, and the crawler dozer reenters the loading phase. The previously-described work cycle is then repeated.

In certain instances, for example, while the crawler dozer is traveling at an incline (positive or negative), and the blade is at a cut depth or height relative to the grade that is below a plane of the crawler dozer. The forward motion of the crawler dozer may be reduced or stopped, due to an operator decision to place a transmission of the crawler dozer in a neutral range, an operator decision to apply a force to a deceleration pedal or due to a resistance force of the pile. In these instances, when the crawler dozer is not moving or is stationary, the GCS may continue to command the blade to a desired cut-depth or height relative to the grade. The movement of the blade in a downward direction while the crawler dozer is stationary may cause the crawler dozer to pitch backwards or bridge due to the difference between the position of the crawler dozer and the position of the blade relative to the grade. This may result in an unsafe work environment, and may potentially result in damage to the crawler dozer.

In other instances, the forward motion of the crawler dozer may be reduced or stopped on level ground. In these instances, when the crawler dozer is not moving or is stationary, the GCS may continue to command the blade to a desired cut-depth or height relative to the grade. The movement of the blade in a downward direction while the crawler dozer is stationary on a level surface may also cause the crawler dozer to pitch backwards or bridge due to the difference between the position of the crawler dozer and the position of the blade relative to the grade. In certain instances, the crawler dozer may be moving, but a resistance force of the pile may be too great such that the blade is unable to cut through the ground (or other material). In this example, when the crawler dozer is moving, but the blade is unable to cut through the ground (or other material), the GCS may continue to command the blade to a desired cut-depth or height relative to the grade. The movement of the blade in a downward direction while the blade is unable to cut through the ground (or other material) may cause the crawler dozer to pitch backwards or bridge due to the difference between the position of the crawler dozer and the position of the blade relative to the grade. Both of these examples may also result in an unsafe work environment, and may potentially result in damage to the crawler dozer.

Generally, the disclosed systems and methods (and work vehicles in which they are implemented, such as the crawler dozer) provide for anti-bridging of the work vehicle as compared to conventional systems by outputting an offset to move the blade to a height that is about the same as a current height of a cutting edge of the blade when the work vehicle is stationary and a plane angle associated with the work vehicle is greater than a threshold. In addition, the disclosed systems and methods (and work vehicles in which they are implemented, such as the crawler dozer) also provide for anti-bridging of the work vehicle as compared to conventional systems by outputting an offset to move the blade to a height that is about the same as a current height of a cutting edge of the blade when the work vehicle is moving, a plane angle associated with the work vehicle is greater than a threshold and the direction of the blade commanded by the GCS is the same direction of motion of a chassis of the work vehicle. By outputting an offset to move the blade to the height that is about the same as the current height of the cutting edge of the blade, the GCS is no longer commanding the downward movement of the blade, and thus, the plane angle associated with the work vehicle may be moved closer to zero degrees, thereby reducing the pitch of the work vehicle relative to the blade.

In one example, the anti-bridging system and method cooperates with the GCS to inhibit the bridging of the crawler dozer. Generally, the anti-bridging system and method computes an offset for the height of the blade relative to the grade that inhibits the bridging of the crawler dozer, and the anti-bridging system and method outputs this height as an offset to the GCS. On receipt of the offset, the GCS raises the blade to a height based on the offset, which inhibits the backward pitching or bridging of the crawler dozer.

As noted above, the disclosed anti-bridging system and method may be utilized with regard to various work vehicles, including crawler dozers, graders, tractors with bladed implements, skid-steer loaders etc. Referring to FIG. 1, in some embodiments, the disclosed anti-bridging system may be used with a work vehicle, such as a crawler dozer 10, to provide for anti-bridging of the crawler dozer 10.

In the embodiment depicted, the crawler dozer 10 includes a chassis 12, a cab 14 supported by the chassis 12, and a number of operator controls 16 located within the cab 14. The operator controls 16 includes one or more joysticks, various switches or levers, one or more buttons, a touch-screen interface that may be overlaid on a display, a keyboard, a speaker, a microphone associated with a speech recognition system, control pedals, or various other human-machine interface devices. The operator may actuate one or more devices of operator controls 16 for purposes of operating the crawler dozer 10, and for providing input to the anti-bridging system and method of the disclosure. For example, the operator controls 16 includes a control pedal, such as a deceleration pedal 102, which receives operator input to reduce a ground speed of the crawler dozer 10.

The crawler dozer 10 further includes a tracked undercarriage 18 containing top rollers 20, bottom rollers 22, sprockets and/or idlers 24, and twin tracks 26. In further embodiments, the tracked undercarriage 18 can be replaced by a different type of undercarriage including wheels, friction or positively-driven belts, or another ground-engaging mechanism suitable for moving the crawler dozer 10 across a tract of land, such as off-road terrain 28, to cut a grade G identified in FIG. 1. In certain instances, the blade 30 of the crawler dozer 10 may make multiple passes across a surface S to reach the desired grade G.

The crawler dozer 10 further includes a blade 30 having a lower cutting edge 31. The blade 30 is mounted to a forward portion of the chassis 12 by an outer blade control linkage 32, which is constructed of various links, joints, and other structural elements. The blade control linkage 32 may include, for example, a push frame 34 joined to tracked undercarriage 18 at pivot points 36. A blade actuation system 40 is further provided, the components of which may be generally interspersed or integrated with the components of the blade control linkage 32. The blade actuation system 40 can include any number and type of actuators suitable for enabling an operator of the crawler dozer 10 to control the position of the blade 30 relative to the chassis 12. In the illustrated example, the blade actuation system 40 includes two hydraulic lift cylinders 42 (only one of which can be seen in FIG. 1) and two hydraulic pitch cylinders 44 (again only one of which can be seen). The hydraulic lift cylinders 42 are each pivotally coupled to chassis 12 at a first pivot point 46 and further pivotally coupled to blade 30 at a second pivot point 48 such that extension and retraction of the hydraulic lift cylinders 42 raises or lowers the blade 30. Similarly, the hydraulic pitch cylinders 44 are each pivotally coupled to the push frame 34 at a first pivot point 50 and further pivotally coupled to blade 30 at a second pivot point 52 such that extension and retraction of the hydraulic pitch cylinders 44 adjusts the pitch of the blade 30. In certain cases, it may also be possible to adjust the tilt angle of the blade 30 by commanding the hydraulic pitch cylinders 44 to different stroke positions; e.g., by extending one of the hydraulic pitch cylinders 44, while simultaneously retracting the other hydraulic pitch cylinder 44.

As indicated above, the blade control linkage 32 and the blade actuation system 40 shown in FIG. 1 are provided purely by way of non-limiting example. In further embodiments of the crawler dozer 10, the blade control linkage 32 and the blade actuation system 40 can vary such that movement of the blade 30 may be controlled in a different manner. For example, in another embodiment, the blade actuation system 40 may include a single hydraulic pitch cylinder 44, which can be extended or retracted to adjust the blade 30. Additionally, a non-hydraulic, manual mechanism may also be provided for adjusting blade pitch in certain embodiments. Generally, then, it should be understood that the blade control linkage 32 and the blade actuation system 40 can assume any form enabling the height and/or pitch of the blade 30 to be remotely controlled utilizing the operator controls 16 and automatically adjusted by one or more systems onboard the crawler dozer 10, such as a Grade Control System (GCS) 88, in the manner described more fully below.

Figure 2:
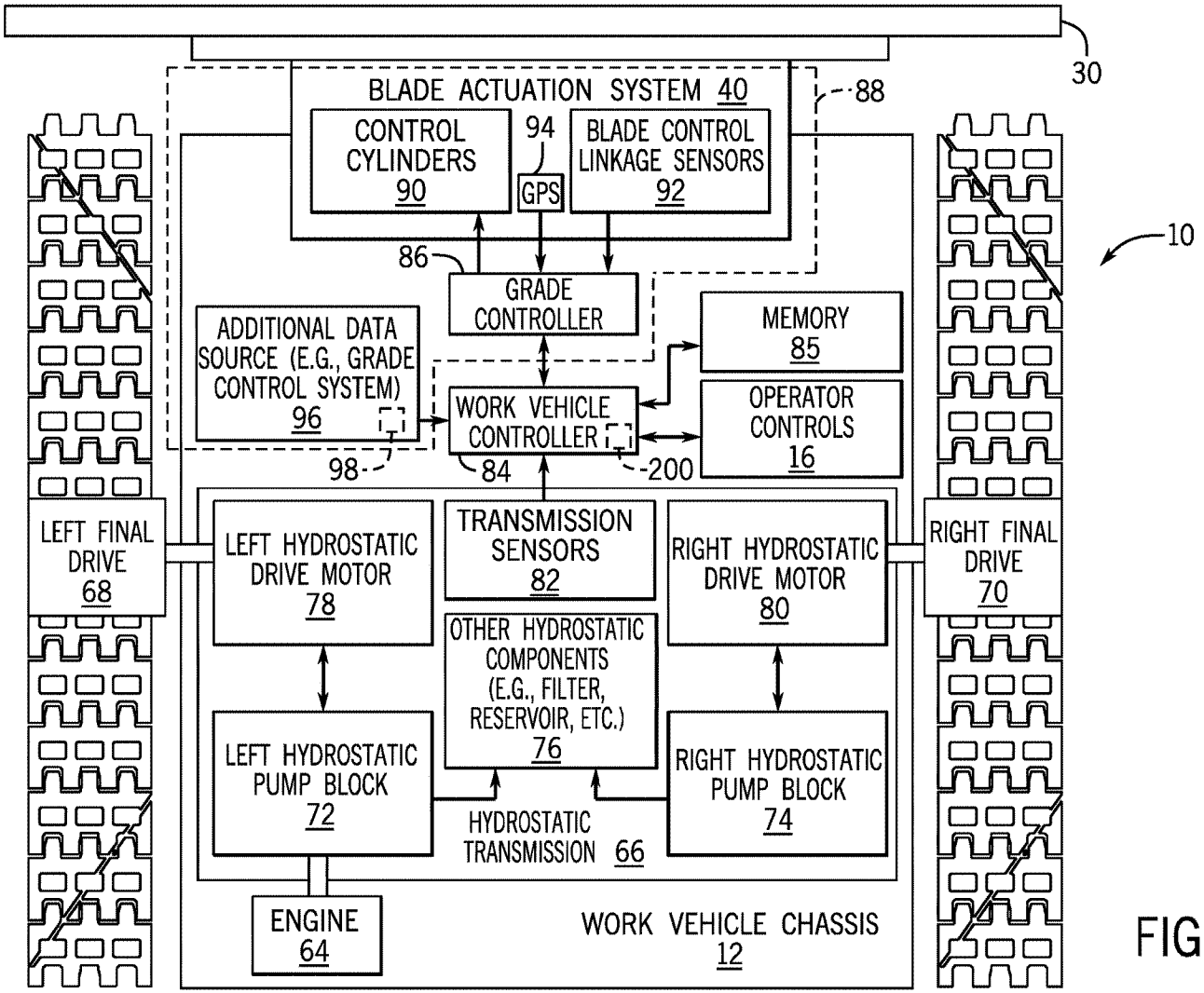
FIG. 2 is a schematic representation of the example crawler dozer shown in FIG. 1, which includes the anti-bridging system.

Advancing now to FIG. 2, a schematic of the example crawler dozer 10 is shown. Here, it can be seen that the crawler dozer 10 includes a number of additional components beyond those previously described in conjunction with FIG. 1. Such additional components can include, for example, an engine 64 (e.g., a diesel engine), a hydrostatic transmission 66, a left final drive 68, and a right final drive 70. During operation of the crawler dozer 10, the engine 64 drives rotation of the tracks 26 through the hydrostatic transmission 66 and the final drives 68, 70. In one example, the rotating mechanical output of the engine 64 drives left and right hydrostatic pumps 72, 74 that may be included within the hydrostatic transmission 66. The hydrostatic pumps 72, 74 are fluidly interconnected through other fluid-conducting components 76 of the hydrostatic transmission 66, such as filters, reservoirs, heat exchangers, and the like. The hydrostatic pumps 72, 74 are further fluidly coupled to and drive hydrostatic motors 78, 80 contained with the hydrostatic transmission 66. The mechanical outputs of the hydrostatic drive motors 78, 80 then drive rotation of sprockets engaging the tracks 26 through the final drives 68, 70. The engine and the powertrain of the crawler dozer 10 (or other bladed work vehicles described herein) may vary in other embodiments.

One or more hydrostatic transmission sensors 82 are further included in the hydrostatic transmission 66. The hydrostatic transmission sensors 82 can include pressure sensors for monitoring the loop pressure differential across the hydrostatic transmission 66, sensors for monitoring the piston displacements of the hydrostatic drive motors 78, 80, and/or sensors for measuring various other operational characteristics of the hydrostatic transmission 66, such as a current operating range of the hydrostatic transmission 66. In one example, the hydrostatic transmission 66 may be operable in a high range, a low range and a neutral range, among others. During operation of the crawler dozer 10, the hydrostatic transmission sensors 82 observe conditions associated with the hydrostatic transmission 66 and generate sensor signals or sensor data that is communicated to the work vehicle controller 84 onboard the crawler dozer 10. For example, the hydrostatic transmission sensors 82 observe the current operating range of the hydrostatic transmission 66 and generate sensor signals based thereon. The one or more controllers are schematically represented in FIG. 2 by a single block "84" and will be referred to as "work vehicle controller 84" hereafter for ease of reference. It will be noted, however, that the work vehicle controller 84 can include any number of processing devices, which can be distributed throughout the crawler dozer 10 and interconnected utilizing different communication protocols and memory architectures.

Generally, the work vehicle controller 84 (or multiple controllers) may be provided, for control of various aspects of the operation of the crawler dozer 10, in general. The work vehicle controller 84 (or others) may be configured as a computing device with associated processor devices and memory architectures 85, as a hard-wired computing circuit (or circuits), as a programmable circuit, as a hydraulic, electrical or electro-hydraulic controller, or otherwise. As such, the work vehicle controller 84 may be configured to execute various computational and control functionality with respect to the crawler dozer 10 (or other machinery). In some embodiments, the work vehicle controller 84 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the work vehicle controller 84 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The work vehicle controller 84 may be in electronic, hydraulic, mechanical, or other communication with various other systems or devices of the crawler dozer 10 (or other machinery). For example, the work vehicle controller 84 may be in electronic or hydraulic communication with various actuators, sensors, and other devices within (or outside of) the crawler dozer 10, including various devices associated with the hydrostatic pumps 72, 74, components 76, GCS 88, hydrostatic drive motors 78, 80, hydrostatic transmission sensors 82, blade control linkage sensors 92, additional data sources 96 and so on. The work vehicle controller 84 may communicate with other systems or devices in various known ways, including via a CAN bus (not shown) of the crawler dozer 10, via wireless or hydraulic communication means, or otherwise. An example location for the work vehicle controller 84 is depicted in FIGS. 1 and 2. It will be understood, however, that other locations are possible including other locations on the crawler dozer 10, or various remote locations. The work vehicle controller 84 receives input commands and interacts with the operator via the operator controls 16, such as the deceleration pedal 102.

As noted above, crawler dozer 10 further includes the blade actuation system 40. In one example, the blade actuation system 40 is controlled by a grade controller 86 of the GCS 88. The blade actuation system 40 contains a number of blade control linkage cylinders 90 and blade control linkage sensors 92. As schematically illustrated in FIG. 2, the blade control linkage cylinders 90 encompass the hydraulic lift cylinders 42 and the hydraulic pitch cylinders 44 described above in conjunction with FIG. 1. The grade controller 86 is further operably coupled to the blade control linkage cylinders 90 and can transmit commands thereto. The grade controller 86 may transmit such commands to the blade control linkage cylinders 90 in accordance with operator input received via the operator controls 16 and communicated to the grade controller 86 by the work vehicle controller 84, or in response to automatic blade adjustments determined by the grade controller 86 of the GCS 88.

The blade control linkage sensors 92 observe a condition associated with the blade 30, for example, a position of the blade 30, such as a pitch and a height of the blade 30 relative to gravity, and generate sensor signals or sensor data based on the observation. The blade control linkage sensors 92 communicate these sensor signals to the grade controller 86, which processes these sensor signals and outputs data for the work vehicle controller 84. Generally, the blade control linkage sensors 92 may include various different combinations of force sensors (e.g., load cells) for measuring the forces applied through the blade 30 and the blade control linkage 32, positional sensors (e.g., magnetostrictive linear position sensors) for measuring the stroke of any or all of the blade control linkage cylinders 90, vibration sensors, wear sensors, and/or various other sensors for monitoring the operational parameters of the blade actuation system 40, including one or more cameras, depth sensors, etc. In one example, the blade control linkage sensors 92 comprise one or more inertial measurement units (IMUs) that observe a linear and an angular position of the blade 30 relative to gravity and generate sensor signals based thereon.

The grade controller 86 of the GCS 88 may be configured as a computing device with associated processor devices and memory architectures, as a hard-wired computing circuit (or circuits), as a programmable circuit, as a hydraulic, electrical or electro-hydraulic controller, or otherwise. As such, the grade controller 86 may be configured to execute various computational and control functionality with respect to the crawler dozer 10 (or other machinery). In some embodiments, the grade controller 86 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the grade controller 86 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements. The grade controller 86 may be in electronic, hydraulic, mechanical, or other communication with various other systems or devices of the crawler dozer 10 (or other machinery). For example, the grade controller 86 may be in electronic or hydraulic communication with various actuators, sensors, and other devices within (or outside of) the crawler dozer 10, including a global positioning system (GPS) 94, the blade control linkage cylinders 90 and the blade control linkage sensors 92. The grade controller 86 may communicate with other systems or devices in various known ways, including via a CAN bus (not shown) of the crawler dozer 10, via wireless or hydraulic communication means, or otherwise. An example location for the grade controller 86 is depicted in FIG. 2. It will be understood, however, that other locations are possible including other locations on the crawler dozer 10, or various remote locations. The grade controller 86 is in communication with the work vehicle controller 84 over a suitable communication architecture, such as the CAN bus associated with the crawler dozer 10.

The work vehicle controller 84 may also receive data inputs from additional data sources 96, which are further coupled to one or more inputs of the work vehicle controller 84 and which can be distributed across the infrastructure of the example crawler dozer 10. The additional data sources 96 can include any number of sensors generating data that may be utilized by the work vehicle controller 84 in performing embodiments of the below-described anti-bridging system. In one example, one or more of these sensors are associated with the GCS 88. For example, such additional data sources 96 can include, for example, crawler dozer position data and ground speed data received from the GPS 94 included in the GCS 88 installed on the crawler dozer 10.

Additionally or alternatively, with reference to FIG. 1, the data sources 96 further include a chassis pitch angle sensor 98 included in the GCS 88. In one example, the chassis pitch angle sensor 98 is an inertial measurement unit (IMU) that observes a linear and an angular position of the chassis 12 relative to gravity and generates sensor signals based thereon, which are communicated to the work vehicle controller 84. In various embodiments, the chassis pitch angle is an angle $\alpha$ of a plane P defined by a bottom surface 26*a* of the tracks 26 relative to an orthogonal vector to gravity (FIG. 1). The chassis pitch angle sensor 98 also observes an acceleration of the crawler dozer, which is transmitted to the work vehicle controller 84. Based on a magnitude of the acceleration, such as positive for forward motion and negative for rearward motion, the work vehicle controller 84 may determine a direction of motion of the chassis 12 of the crawler dozer.

The data sources 96 also include a blade commanded direction data input, which is a direction of the movement for the blade 30 as commanded by the GCS 88. Generally, the blade commanded direction data input may be positive for forward movement of the blade 30 and negative for rearward movement of the blade 30.

In addition, the work vehicle controller 84 receives one or more inputs from the operator controls 16. For example, the operator controls 16 includes the deceleration pedal 102, and a pedal position sensor 104 may observe an angular position of the deceleration pedal 102 and generate sensor signals or sensor data based on the observation. The pedal position sensor 104 is generally an angular position sensor, including, but not limited to, an angular potentiometer, a Hall Effect sensor and so on.

The various components noted above (or others) may be utilized to control movement of the blade 30 via control of the movement of the one or more blade control linkage cylinders 90. Accordingly, these components may be viewed as forming part of the anti-bridging system for the crawler dozer 10. Each of the sensors 82, 92, 98, 104, the GPS 94, the GCS 88, the grade controller 86 and the operator controls 16 are in communication with the work vehicle controller 84 via a suitable communication architecture, such as a CAN bus.

In various embodiments, the work vehicle controller 84 includes an anti-bridging control module 200 embedded within the work vehicle controller 84. In various embodiments, the anti-bridging control module 200 generates an offset for the GCS 88 to move the blade 30 to inhibit the bridging of the crawler dozer 10 based on sensor signals or sensor data from the sensors 82, 92, 98, 104, data from the GPS 94, data from the additional data sources 96, input data and commands from the operator controls 16 and further based on the anti-bridging system and method of the present disclosure.

Figure 3:
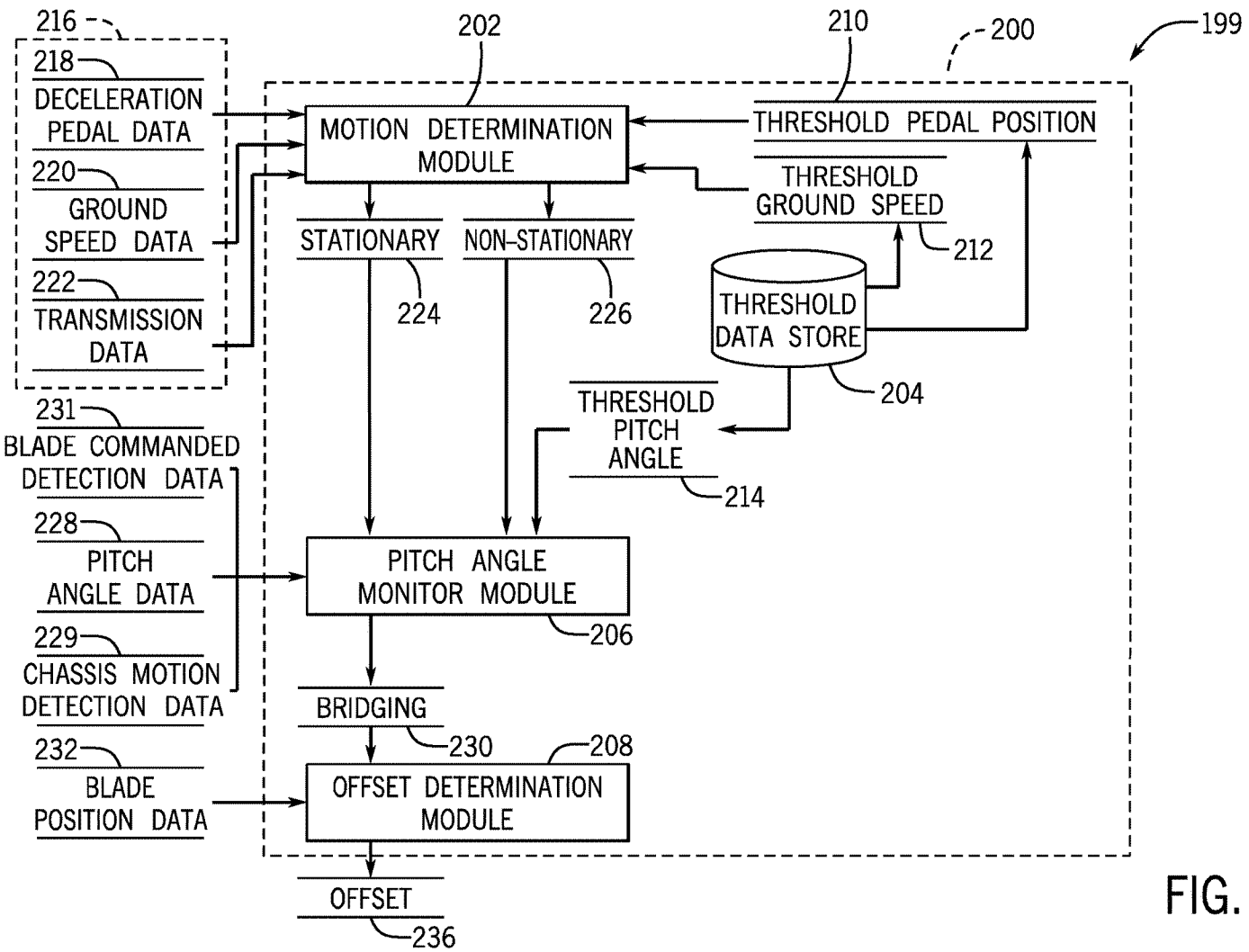
FIG. 3 is a dataflow diagram illustrating an example anti-bridging system for the work vehicle of FIG. 1 in accordance with various embodiments.

Referring now also to FIG. 3, a dataflow diagram illustrates various embodiments of an anti-bridging system 199 for the crawler dozer 10, which may be embedded within the anti-bridging control module 200 of the work vehicle controller 84. Various embodiments of the anti-bridging system 199 according to the present disclosure may include any number of sub-modules embedded within the work vehicle controller 84. As may be appreciated, the sub-modules shown in FIG. 3 may be combined and/or further partitioned to similarly generate an offset for adjusting a position of the blade 30 by the GCS 88 via control of the blade control linkage cylinders 90, for example, the hydraulic lift cylinders 42. Inputs to the anti-bridging system 199 may be received from the operator controls 16, such as the deceleration pedal 102 (FIG. 1), received from the sensors 82, 92, 98, 104, received from the GPS 94, received from the additional data sources 96, received from the grade controller 86, received from other control modules (not shown) associated with the crawler dozer 10, and/or determined/modeled by other sub-modules (not shown) within the work vehicle controller 84. In various embodiments, the anti-bridging control module 200 includes a motion determination module 202, a threshold datastore 204, a pitch angle monitor module 206 and an offset determination module 208.

The threshold datastore 204 stores one or more thresholds for various parameters associated with the operation of the crawler dozer 10. In one example, the threshold datastore 204 stores one or more thresholds that are utilized in determining whether the crawler dozer 10 is pitching backwards or bridging. Generally, the threshold datastore 204 stores a threshold pedal position 210, a threshold ground speed 212 and a threshold pitch angle 214. Each of these thresholds, the threshold pedal position 210, the threshold ground speed 212 and the threshold pitch angle 214, are predefined or factory set values associated with a particular crawler dozer 10. The threshold pedal position 210 is a pre-defined threshold value for an angular position of the deceleration pedal 102. In one example, the threshold pedal position 210 is about 90% (i.e. the deceleration pedal 102 is about 90% depressed or moved towards a floor of the cab 14). As will be discussed, the motion determination module 202 determines whether the crawler dozer 10 is stationary based on the threshold pedal position 210. The threshold ground speed 212 is a pre-defined threshold value for a ground speed of the crawler dozer 10. In one example, the threshold ground speed 212 is about 8 kilometers per hour (kph). As will be discussed, the motion determination module 202 determines whether the crawler dozer 10 is stationary based on the threshold ground speed 212. The threshold pitch angle 214 is a pre-defined threshold value for the pitch of the chassis 12 (FIG. 1). Stated another way, the threshold pitch angle 214 is a pre-defined threshold value for the angle $\alpha$ of the plane P of the bottom surface 26*a* of the tracks 26 (FIG. 1). In one example, the threshold pitch angle 214 is about ±25%. As will be discussed, the pitch angle monitor module 206 determines whether the crawler dozer 10 is bridging based on the threshold pitch angle 214.

The motion determination module 202 receives as input work vehicle data 216. Work vehicle data 216 generally comprises deceleration pedal data 218, ground speed data 220 and transmission data 222. The deceleration pedal data 218 includes the sensor signals or sensor data from the pedal position sensor 104. The ground speed data 220 is a current ground speed of the crawler dozer 10, which is received from the GPS 94 associated with the GCS 88. The transmission data 222 includes the sensor signals or sensor data from the hydrostatic transmission sensor 82.

The motion determination module 202 processes the transmission data 222, and determines a current range of the hydrostatic transmission 66. Based on the determination of the current range of the hydrostatic transmission 66, the motion determination module 202 determines whether the crawler dozer 10 is has been commanded to neutral. If the hydrostatic transmission 66 has been commanded to the neutral range, the motion determination module 202 determines that the crawler dozer 10 is stationary, and sets stationary 224 for the pitch angle monitor module 206. The stationary 224 comprises a flag that indicates that the crawler dozer 10 is stationary.

If the motion determination module 202 determines that the hydrostatic transmission 66 has not been commanded to neutral, the motion determination module 202 determines that the crawler dozer 10 may be non-stationary, and receives the deceleration pedal data 218. The motion determination module 202 processes the deceleration pedal data 218, and determines a current angular position of the deceleration pedal 102. Based on the determination of the current angular position of the deceleration pedal 102, the motion determination module 202 retrieves the threshold pedal position 210 from the threshold datastore 204. The motion determination module 202 determines whether the current angular position of the deceleration pedal 102 is greater than the threshold pedal position 210. If the current angular position of the deceleration pedal 102 is greater than the threshold pedal position 210, the motion determination module 202 determines that the crawler dozer 10 is stationary, and sets the stationary 224 for the pitch angle monitor module 206. Otherwise, if the current angular position of the deceleration pedal 102 is less than the threshold pedal position 210, the motion determination module 202 determines that the crawler dozer 10 may be moving, and receives the ground speed data 220 from the GPS 94 of the GCS 88.

The motion determination module 202 processes the ground speed data 220, which includes the current ground speed of the crawler dozer 10. Based on the determination of the current ground speed of the crawler dozer 10, the motion determination module 202 retrieves the threshold ground speed 212 from the threshold datastore 204. The motion determination module 202 determines whether the current ground speed of the crawler dozer 10 is less than the threshold ground speed 212. If the current ground speed of the crawler dozer 10 is less than the threshold ground speed 212, the motion determination module 202 determines that the crawler dozer 10 is stationary, and sets the stationary 224 for the pitch angle monitor module 206. Otherwise, if the current ground speed of the crawler dozer 10 is greater than the threshold ground speed 212, the motion determination module 202 determines that the crawler dozer 10 is not stationary or is moving, and sets the non-stationary 226 for the pitch angle monitor module 206. The non-stationary 226 comprises a flag that indicates that the crawler dozer 10 is moving.

The pitch angle monitor module 206 receives as input the stationary 224 from the motion determination module 202. Based on receiving the stationary 224, the pitch angle monitor module 206 receives as input pitch angle data 228 from the grade controller 86 of the GCS 88. The pitch angle data 228 is the current pitch of the chassis 12 (FIG. 1) as observed by the chassis pitch angle sensor 98 and received in the sensor signals or sensor data from the chassis pitch angle sensor 98. The pitch angle monitor module 206 processes the pitch angle data 228, and determines a current pitch of the chassis 12 (FIG. 1). Stated another way, the pitch angle monitor module 206 processes the pitch angle data 228, and determines a current angle $\alpha$ for the plane P of the bottom surface 26*a* of the tracks 26. Based on the determined current pitch of the chassis 12 or the current angle $\alpha$, the pitch angle monitor module 206 retrieves the threshold pitch angle 214 from the threshold datastore 204. The pitch angle monitor module 206 determines whether the determined current pitch of the chassis 12 or the current angle $\alpha$ is greater than the threshold pitch angle 214. If the determined current pitch of the chassis 12 or the current angle $\alpha$ is greater than the threshold pitch angle 214, the pitch angle monitor module 206 determines the crawler dozer 10 is bridging and sets bridging 230 for the offset determination module 208. The bridging 230 comprises a flag that indicates that the crawler dozer 10 is bridging.

The pitch angle monitor module 206 also receives as input the non-stationary 226 from the motion determination module 202. Based on receiving the non-stationary 226, the pitch angle monitor module 206 receives as input chassis motion direction data 229 and blade commanded direction data 231. The chassis motion direction data 229 is a current direction of motion of the chassis 12, as observed by the chassis pitch angle sensor 98 and received in the sensor signals or sensor data from the chassis pitch angle sensor 98. The blade commanded direction data 231 is the current direction the blade 30 is commanded to move by the GCS 88, which is received from the additional data sources 96.

The pitch angle monitor module 206 compares the current direction of motion of the chassis 12 to the current direction of the blade 30. If the chassis 12 and the blade 30 are moving in different directions, for example, the current direction of motion of the chassis 12 is negative (i.e. rearward direction), and the current direction of motion of the blade 30 is positive (i.e. positive direction) or vice versa, the pitch angle monitor module 206 receives and processes the pitch angle data 228. Generally, a difference in motion directions between the blade 30 and the chassis 12 occurs in instances where the blade 30 is being commanded to move in one direction, but due to the resistance of the pile is unable to cut into the ground (or other material), which causes the chassis 12 to move in another direction (e.g. the crawler dozer 10 is being lifted instead of cutting). The pitch angle monitor module 206 processes the pitch angle data 228 and determines a current pitch of the chassis 12 (FIG. 1). Stated another way, the pitch angle monitor module 206 processes the pitch angle data 228, and determines a current angle $\alpha$ for the plane P of the bottom surface 26*a* of the tracks 26. Based on the determined current pitch of the chassis 12 or the current angle $\alpha$, the pitch angle monitor module 206 retrieves the threshold pitch angle 214 from the threshold datastore 204. The pitch angle monitor module 206 determines whether the determined current pitch of the chassis 12 or the current angle $\alpha$ is greater than the threshold pitch angle 214. If the determined current pitch of the chassis 12 or the current angle $\alpha$ is greater than the threshold pitch angle 214, the pitch angle monitor module 206 determines the crawler dozer 10 is bridging and sets bridging 230 for the offset determination module 208. The bridging 230 comprises a flag that indicates that the crawler dozer 10 is bridging.

The offset determination module 208 receives as input the bridging 230. Based on the bridging 230, the offset determination module 208 receives as input blade position data 232. The blade position data 232 includes sensor signals or sensor data received from the blade control linkage sensors 92 of the GCS 88 via the grade controller 86.

The offset determination module 208 processes the blade position data 232 and determines a current position or the height H1 of the cutting edge 31 of the blade 30 above the grade G (FIG. 1). Alternatively, the offset determination module 208 may receive the current blade position relative to the grade G from the grade controller 86.

Based on the current height of the cutting edge 31 of the blade 30, the offset determination module 208 determines an offset 236. In one example, the offset 236 is the numerical value of the height H1 of the cutting edge 31 of the blade 30 above the grade G.

The offset determination module 208 outputs the offset 236 to the grade controller 86 of the GCS 88 to adjust the current height of the blade 30 to the offset 236. Stated another way, the grade controller 86 sets the current commanded position or height for the blade 30 such that the blade control linkage cylinders 90 (e.g. the hydraulic lift cylinders 42) are commanded to move the blade 30 to the height H1 that is substantially the same as the current height H1 of the cutting edge 31 of the blade 30 above the grade G, thereby inhibiting bridging of the crawler dozer 10.

Figure 4:
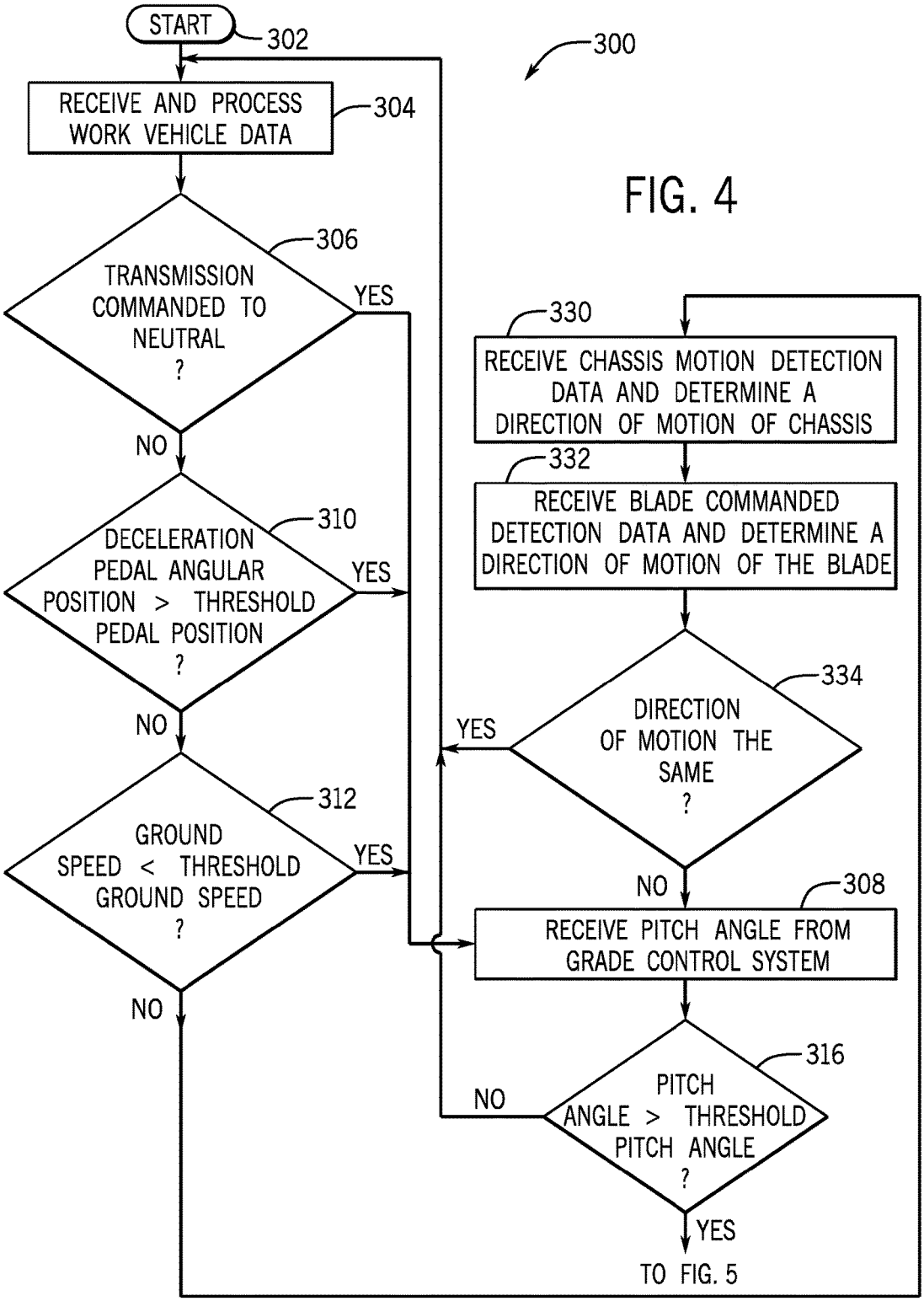
FIG. 4 is a flowchart illustrating a method performed by the anti-bridging system of FIG. 3 in accordance with various embodiments.

Referring now also to FIG. 4, a flowchart illustrates a method 300 that may be performed by the work vehicle controller 84 of FIGS. 1-3 in accordance with the present disclosure. As may be appreciated in light of the disclosure, the order of operation within the method is not limited to the sequential execution as illustrated in FIG. 4, but may be performed in one or more varying orders as applicable and in accordance with the present disclosure.

In various embodiments, the method may be scheduled to run based on predetermined events, and/or may run based on a start-up of the crawler dozer 10, for example.

In one example, the method begins at 302. At 304, the method receives and processes the work vehicle data 216. At 306, the method determines, based on the transmission data 222, whether the hydrostatic transmission 66 is commanded to neutral. If true, the method proceeds to 308.

Otherwise, at 310, the method determines, based on the deceleration pedal data 218, the current angular position of the deceleration pedal 102. Based on this determination, the method retrieves the threshold pedal position 210 from the threshold datastore 204, and determines whether the current angular position of the deceleration pedal 102 is greater than the threshold pedal position 210. If true, the method proceeds to 308.

Otherwise, at 312, method determines, based on the ground speed data 220, the current ground speed of the crawler dozer 10. Based on this determination, the method retrieves the threshold ground speed 212 from the threshold datastore 204, and determines whether the current ground speed of the crawler dozer 10 is less than the threshold ground speed 212. If true, the method proceeds to 308. Otherwise, the method determines the crawler dozer 10 is moving and proceeds to 330.

At 308, the method receives the pitch angle data 228 from the grade controller 86 of the GCS 88. The method processes the pitch angle data 228 and determines the current pitch of the chassis 12 or the current angle $\alpha$ of the plane P of bottom surface 26*a* of the tracks 26. At 316, the method retrieves the threshold pitch angle 214 from the threshold datastore 204 and determines whether the current angle of the plane P is greater than the threshold pitch angle 214. If true, the method proceeds to 318 on FIG. 5. Otherwise, the method loops to 306.

Figure 5:
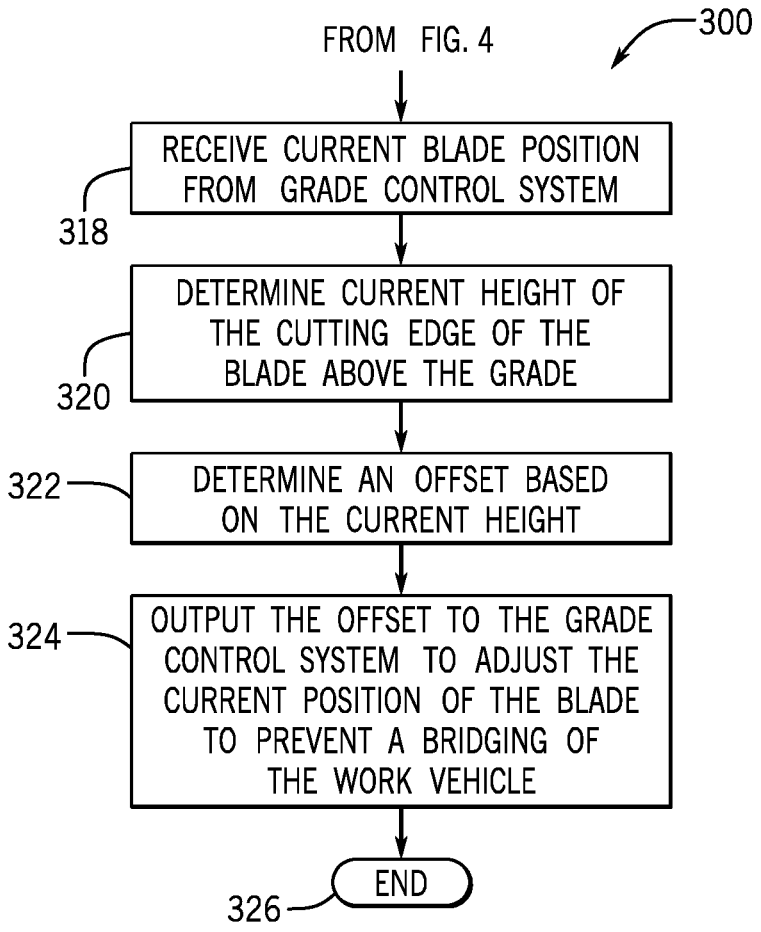
FIG. 5 is a continuation of the flowchart of FIG. 4.

With reference to FIG. 5, at 318, the method receives the blade position data 232 from the grade controller 86 of the GCS 88. At 320, the method processes the blade position data 232 to determine the current position or the height H1 of the cutting edge 31 of the blade 30 above the grade G (FIG. 1).

At 322, the method determines the offset 236 based on the determined current position or the height H1 of the cutting edge 31 of the blade 30 above the grade G (FIG. 1). In one example, the offset 236 is the numerical value of the height H1. At 324, the method outputs the offset 236 to the grade controller 86 of the GCS 88 to adjust the current position or height of the blade 30 to the height H1 to inhibit a bridging of the crawler dozer 10. Generally, the grade controller 86 of the GCS 88 sets the current commanded height of the blade 30 to the height H1 and outputs one or more control commands for the blade control linkage cylinders 90 (e.g. the hydraulic lift cylinders 42) to move the blade 30 to the height H1 to inhibit the bridging of the crawler dozer 10. The method ends at 326.

With reference to FIG. 4, at 330, the method receives the chassis motion direction data from the chassis pitch angle sensor 98 and determines a direction of motion of the chassis 12. At 332, the method receives the blade commanded direction data from the additional data sources 96 of the GCS 88, and determines a direction of motion of the blade 30. At 334, the method determines whether the direction of motion of the chassis 12 matches the direction of motion of the blade 30. If true, the method loops to 304. Otherwise, if false, the method proceeds to 308.

As will be appreciated by one skilled in the art, certain aspects of the disclosed subject matter may be embodied as a method, system (e.g., a work vehicle control system included in a work vehicle), or computer program product. Accordingly, certain embodiments may be implemented entirely as hardware, entirely as software (including firmware, resident software, micro-code, etc.) or as a combination of software and hardware (and other) aspects. Furthermore, certain embodiments may take the form of a computer program product on a computer-usable storage medium having computer-usable program code embodied in the medium.

Any suitable computer usable or computer readable medium may be utilized. The computer usable medium may be a computer readable signal medium or a computer readable storage medium. A computer-usable, or computer-readable, storage medium (including a storage device associated with a computing device or client electronic device) may be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium may be any tangible medium that may contain, or store a program for use by or in connection with the instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be non-transitory and may be any computer readable medium that is not a computer readable storage medium and that may communicate, propagate, or transport a program for use by or in connection with an instruction execution system, apparatus, or device.

Aspects of certain embodiments are described herein may be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that may direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, may illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block (or otherwise described herein) may occur out of the order noted in the figures. For example, two blocks shown in succession (or two operations described in succession) may, in fact, be executed substantially concurrently, or the blocks (or operations) may sometimes be executed in the reverse order, depending upon the functionality involved. It will also be noted that each block of any block diagram and/or flowchart illustration, and combinations of blocks in any block diagrams and/or flowchart illustrations, may be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A method for adjusting a position of an implement of a work vehicle to inhibit a bridging of the work vehicle, the implement movable by a hydraulic circuit controlled by a Grade Control System, the method comprising:

receiving, by a processor associated with the work vehicle, a chassis pitch angle associated with a chassis of the work vehicle from the Grade Control System;

determining, by the processor, whether the chassis pitch angle is greater than a predefined threshold;

receiving, by the processor, a current height of the implement relative to a grade from the Grade Control System;

based on determining that the chassis pitch angle is greater than the predefined threshold, determining, by the processor, an offset to move the implement to a height above the grade based on the current height of the implement; and outputting, by the processor, the offset to the Grade Control System to move the implement to inhibit the bridging of the work vehicle.

2. The method of claim 1, further comprising:

determining, by the processor, whether the work vehicle is in motion; and performing the determining of whether the chassis pitch angle is greater than the predefined threshold based on the determination of whether the work vehicle is in motion.

3. The method of claim 2, wherein the performing of the determining of whether the chassis pitch angle is greater than the predefined threshold is based on the processor determining that the work vehicle is stationary.

4. The method of claim 3, wherein the determining, by the processor, that the work vehicle is stationary further comprises:

determining a position of a deceleration pedal based on one or more sensor signals received from a deceleration pedal sensor.

5. The method of claim 3, wherein the determining, by the processor, that the work vehicle is stationary further comprises:

determining that a ground speed of the work vehicle is less than a predefined threshold ground speed.

6. The method of claim 3, wherein the determining, by the processor, that the work vehicle is stationary further comprises:

determining that a transmission of the work vehicle is commanded to a neutral position.

7. The method of claim 1, further comprising:

determining, by the processor, whether the work vehicle is in motion;

based on the determination that the work vehicle is in motion, receiving, by the processor, a direction of motion of a chassis of the work vehicle from a source and a direction of motion of the implement from the Grade Control System;

determining, by the processor, whether the direction of motion of the work vehicle matches the direction of motion of the implement; and performing the determining of whether the chassis pitch angle is greater than the predefined threshold is based on the determination that the direction of motion of the work vehicle different than the direction of motion of the implement.

8. A system for adjusting a position of a blade of a work vehicle to inhibit a bridging of the work vehicle, the blade movable by a hydraulic circuit controlled by a Grade Control System, the system comprising:

a chassis pitch angle received from the Grade Control System that indicates a pitch of a chassis associated with the work vehicle;

a current blade height received from the Grade Control System that indicates a current height of the blade relative to a grade;

a processor that:

determines whether the chassis pitch angle is greater than a predefined threshold;

based on the determination that the chassis pitch angle is greater than the predefined threshold, determines an offset to move the blade to a height above the grade based on the current height of the blade; and outputs the offset to the Grade Control System to move the blade to the height above the grade to inhibit the bridging of the work vehicle.

9. The system of claim 8, wherein the processor determines whether the work vehicle is in motion prior to determining whether the chassis pitch angle is greater than the predefined threshold.

10. The system of claim 8, wherein the processor determines that the work vehicle is stationary prior to determining whether the chassis pitch angle is greater than the predefined threshold.

11. The system of claim 10, wherein the processor determines that the work vehicle is stationary based on one or more sensor signals received from a deceleration pedal sensor.

12. The system of claim 10, wherein the processor determines that the work vehicle is stationary based on a ground speed of the work vehicle as less than a predefined threshold ground speed.

13. The system of claim 8, wherein the chassis pitch angle is an angle defined between a plane taken through one or more tracks associated with the work vehicle.

14. The system of claim 8, wherein the processor determines that the work vehicle is in motion and based on the determination that the work vehicle is in motion, the processor receives a direction of motion of a chassis of the work vehicle from a source and a direction of motion of the blade from the Grade Control System, and the processor determines whether the direction of motion of the work vehicle matches the direction of motion of the blade.

15. The system of claim 14, wherein the processor determines whether the chassis pitch angle is greater than the predefined threshold is based on the determination that the direction of motion of the work vehicle is different than the direction of motion of the blade.

16. A system for adjusting a position of a blade of a work vehicle to inhibit a bridging of the work vehicle, the blade movable by a hydraulic circuit controlled by a Grade Control System, the system comprising:

a chassis pitch angle received from the Grade Control System that indicates a pitch of a chassis of the work vehicle;

a current blade position received from the Grade Control System that indicates a current height of the blade relative to a grade;

a processor that:

determines whether the work vehicle is stationary based on work vehicle data received from a source associated with the work vehicle;

based on the determination that the work vehicle is stationary, determines whether the chassis pitch angle is greater than a predefined threshold;

based on the determination that the chassis pitch angle is greater than the predefined threshold, determines an offset to move the blade to a height above the grade based on the current height of the blade; and outputs the offset to the Grade Control System to move the blade to the height above the grade to inhibit the bridging of the work vehicle.

17. The system of claim 16, wherein the processor determines that the work vehicle is stationary based on one or more sensor signals received from a deceleration pedal sensor.

18. The system of claim 16, wherein the processor determines that the work vehicle is stationary based on a ground speed of the work vehicle as less than a predefined threshold ground speed.

19. The system of claim 16, wherein the processor determines that the work vehicle is in motion based on the work vehicle data, and based on the determination that the work vehicle is in motion, the processor receives a direction of motion of a chassis of the work vehicle from a source and a direction of motion of the blade from the Grade Control System, and the processor determines whether the direction of motion of the work vehicle matches the direction of motion of the blade.

20. The system of claim 19, wherein the processor determines whether the chassis pitch angle is greater than the predefined threshold based on the determination that the direction of motion of the work vehicle is different than the direction of motion of the blade.

* * * * *